United States Patent [19]

Over et al.

[11] 4,035,897

[45] July 19, 1977

[54] APPARATUS FOR CONNECTING CONDUCTORS TO CONTACT TERMINALS IN AN ELECTRICAL CONNECTOR

[75] Inventors: William Roderick Over, Harrisburg; Ronald Carl Brehm, Carlisle, both of Pa.

[73] Assignee: AMP Incorporated, Harrisburg, Pa.

[21] Appl. No.: 693,655

[22] Filed: June 7, 1976

[51] Int. Cl.[2] ..... H01R 43/04

[52] U.S. Cl. ..... 29/56.6; 29/749; 29/760

[58] Field of Search ..... 29/203 MW, 203 J, 203 P, 29/203 D, 203 DT, 203 H, 203 HT, 628

[56] References Cited

U.S. PATENT DOCUMENTS

| | | | |
|---|---|---|---|
| 3,845,535 | 11/1974 | Over | 29/203 MW |
| 3,953,916 | 5/1976 | Rolland et al. | 29/203 MW |

*Primary Examiner*—Carl E. Hall

*Attorney, Agent, or Firm*—Frederick W. Raring; Robert W. Pitts; Jay L. Seitchik

[57] ABSTRACT

Apparatus for inserting wires into the wire-receiving portions of terminals in an electrical connector housing comprises a wire-inserting press and a fixture means which is separate from the press and which can be mounted on the press during the inserting operation. The fixture means comprises a block-like member having wire-locating means and housing positioning means thereon arranged such that when the housing and wires are located on the fixture means, the wires will be in alignment with the terminals in the housing. When the fixture means and press are assembled to each other and the press ram is moved towards the fixture means, cooperative aligning pins and sockets on the fixture and on the press ram move into engagement with each other precisely to align the wires and the connector housing with the insertion punches on the press ram. The wires may be sheared immediately prior to insertion by means of fixed and movable shears which are provided on the press, the fixture means being so constructed as to receive the fixed shear when the fixture means is assembled to the press.

21 Claims, 13 Drawing Figures

10
9
96
98
100
29
31
30
36
62
58
46
65
68
48
50
52
54
56
44
60
41
38
39
74
184
73
72
70
4
126
148
136
146

APPARATUS FOR CONNECTING CONDUCTORS TO CONTACT TERMINALS IN AN ELECTRICAL CONNECTOR

BACKGROUND OF THE INVENTION

This invention relates to apparatus of the general class shown in U.S. Pat. No. 3,845,535 for inserting wires into the wire receiving portions of contact terminals which are contained in an electrical connector housing. Other prior U.S. patents which are pertinent to the instant invention are: U.S. Pat. Nos. 3,866,296, 3,953,916, and 3,800,390.

U.S. Pat. No. 3,845,535 discloses and claims a wire-inserting and trimming apparatus comprising an insertion press which is removably mounted on a base, the base serving as a fixture for holding the wires and connector during the insertion operation. The base also has fixed shearing edges therein which cooperate with movable shearing edges on the press ram so that the wires are trimmed immediately prior to insertion into the terminals in the connector.

The apparatus shown in U.S. Pat. No. 3,845,535 has received favorable comment in the electrical industry and the principles of its design are being increasingly accepted. The instant invention is specifically directed to the achievement of an apparatus of the general class shown in the above-identified patent which can be produced or manufactured at reduced cost and which can be used under a variety of circumstances so that the principle of the invention disclosed in U.S. Pat. No. 3,845,535 might find more wide-spread application in the electrical industry.

In accordance with the instant invention a relatively simple fixture is provided which has locating means for locating the connector and the wires therein so that the wires will be precisely aligned with the terminals in the connector. Cooperable aligning means are provided on the fixture and on the insertion press for precisely aligning the fixture during movement of the press ram towards the fixture so that the insertion punches on the press ram will engage the wires and move them into the wire receiving portions of the terminals in the connector. During such movement of the ram, the fixture means will be moved very slightly to bring it into the precise alignment required, a feature which precludes the requirement of fixed or permanent aligning means on the fixture and the press.

A further significant feature of the instant invention as compared to the apparatus shown in U.S. Pat. No. 3,845,535 is that the fixed shearing means for shearing the wires immediately prior to insertion into the terminals is provided on the press rather than on the fixture. It is thus unnecessary to provide this relatively expensive component, the fixed shear, on the fixture and the fixture can, therefore, be a relatively inexpensive part of the apparatus.

It is accordingly an object of the invention to provide an improved apparatus for inserting wires into the wire-receiving portions of terminals in an electrical connector housing. A further object is to provide a two-part apparatus comprising an improved fixture for wires in a connector and a separate insertion press. A further object is to provide an apparatus having a wire and connector fixture which can be manufactured at an extremely low cost. A further object is to provide an improved apparatus for making electrical harnesses.

These and other objects of the invention are achieved in preferred embodiments thereof which are briefly described in the foregoing abstract, which are described in detail below, and which are shown in the accompanying drawing in which.

Figure 1:
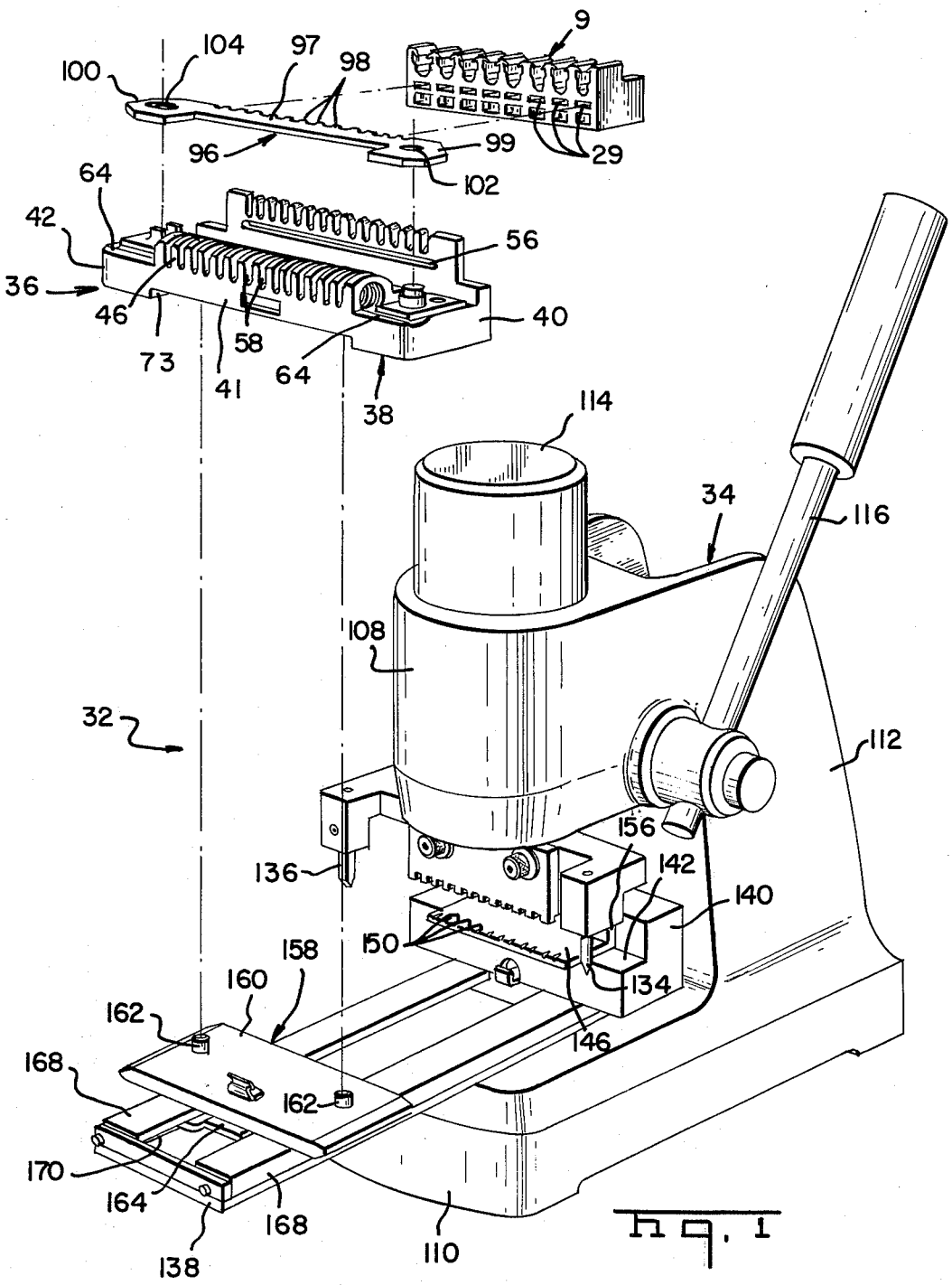
FIG. 1 is a perspective view of one form of apparatus in accordance with the invention.

The embodiment of the invention shown in FIG. 1 is adapted to trim the ends of each of a plurality of wires 4 and insert the wires into the wire-receiving slots 16 of terminals which are arranged in a row in an electrical connector 9.

Each terminal 8 has a pair of spaced apart plate-like sections 12 which are connected at their upper ends by strap members 14 and which are provided with aligned slots 16 for reception of the wires. The slots have a width which is less than the diameter of the conducting core of a wire so that upon insertion, the edges of the slot will penetrate the insulation of the wire and establish electrical contact with the conducting core. In the disclosed embodiment, the rearward plate section 12 has a reversely extending arm 15 integral therewith which bears against the front plate section for strengthening purposes. This front plate section has a forwardly extending tongue 18 from the edges of which there extend depending arms 20. Contact springs 22 extend from these arms beneath the wire receiving portion 16, these contact springs being adapted to receive a terminal post in a printed circuit board or the like.

Figure 2:
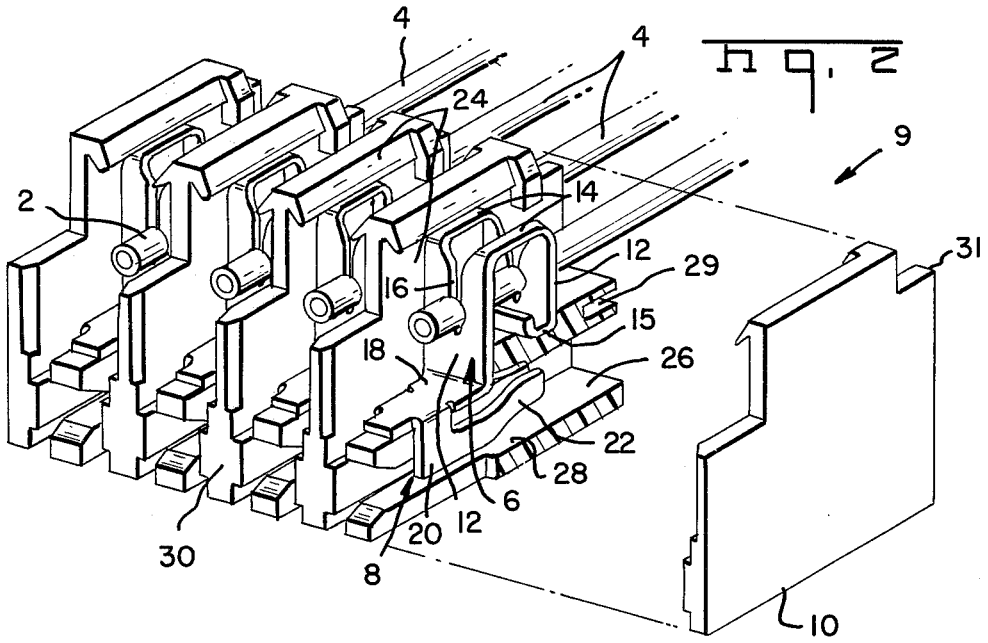
FIG. 2 is a perspective view of an electrical connector of the type for which the embodiment of FIG. 1 is intended.

The housing 10 of the connector is generally prismatic and has spaced apart barrier walls 24 on its upper side between which the wire receiving portions 6 of the terminals are mounted. The upper side is recessed as shown at 26 and the wire receiving portions 6 and tongues 18 are contained in these recesses. The contact springs 22 extend through aligned openings or passageways 28 which extend through the housing from the oppositely directed sides 30, 31 thereof. As shown in FIG. 2, the wires 4 extend towards the side 31 of the housing and each wire extends between an adjacent pair of barrier walls 24 with the end of the wire disposed in the wire receiving slots of the terminal. It will be noted that the housing has a row of additional recesses 29 extending inwardly from the side 31 thereof. These recesses receive tooth members on a positioning bar which forms part of the fixture means as will be described below.

The apparatus 32 in accordance with the embodiment of FIG. 1 comprises a bench press 34 and a separate fixture means 36 which can be removed from the press when the wires and connector are positioned in the fixture means as will be described below.

Figure 4:
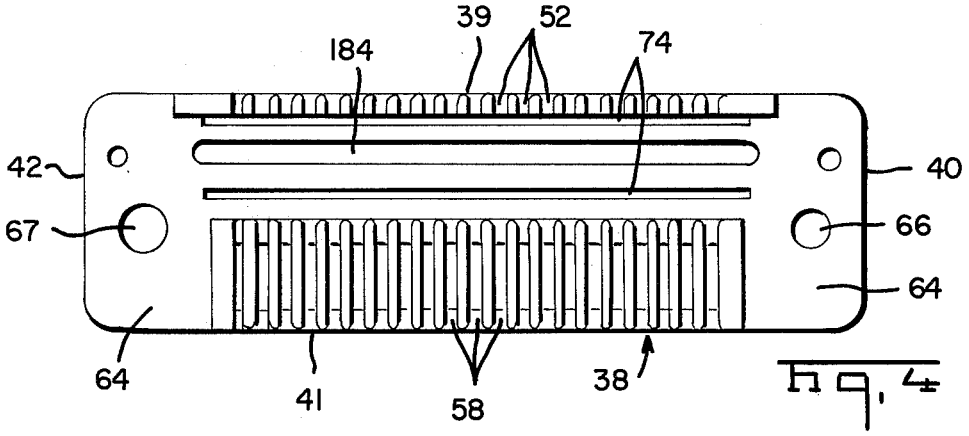
FIG. 4 is a top plan view of a fixture means which forms part of the apparatus.
Figures 5, 6, 7, 8:
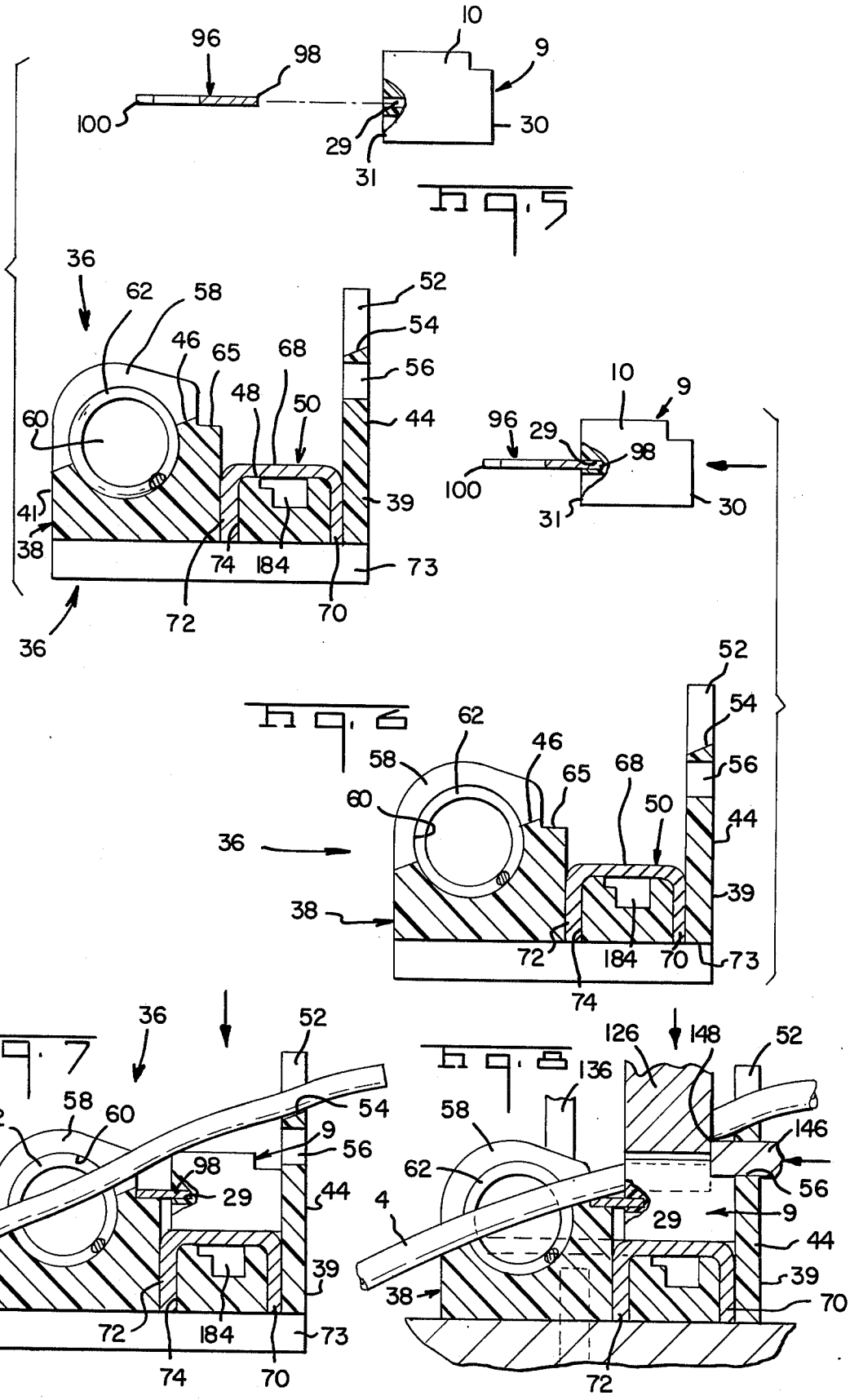
FIG. 5 is a cross-sectional view of the fixture means of FIG. 4; this view also shows a connector and a positioning bar used in conjunction with the fixture means.
FIG. 6 is a view similar to FIG. 5 illustrating the manner in which the connector housing is mounted on the positioning bar.
FIG. 7 is a cross-sectional view of the fixture means with the connector positioned thereon and the wires located in alignment with the terminals in the connector.
FIG. 8 is a view similar to FIG. 7 illustrating the trimming and insertion step.

The fixture means, FIGS. 1, 4, and 6, comprises a generally prismatic block 38 of suitable plastic material, such as glass-filled nylon, having ends 40, 42 and sides 39, 41. A wall 44 extends upwardly from the side 39 and a relatively thicker wall 46 extends upwardly from the side 41. These two walls define a transversely extending recess 48 in which a load transmitting member 50 is located. The connector housing is positioned on the load transmitting member and precisely located in the recess as will be described below.

The upper end of the wall 44 is provided with spaced apart wire-receiving notches 52, the spacing between adjacent notches being the same as the spacing between adjacent terminals in the connector. The inner ends 54 of the notches 52 slope downwardly and towards the recess 48 and a transversely extending slot 56 is provided in the wall 44 beneath the inner ends of the notches. This slot 56 provides clearance for a fixed shear member which extends through the slot when the fixture is located on the insertion press.

The relatively thick wall 46, which is lower than the wall 44, is also provided with spaced apart notches 58 which are in alignment with the notches 52. The inner ends of these notches slope downwardly and away from the recess 48 as viewed in FIG. 5 so that wires positioned in the notches will extend obliquely above the connector supported in the recess 48 as shown in FIG. 7. A circular opening 60 extends through the wall 46 between the ends thereof and a coil spring 62 is disposed in this opening. The purpose of this spring is to hold the wires as shown in FIG. 7 on the fixture, the spacing between adjacent coils in the spring being such that the wires will be gripped and held in place.

The surface portions 64 of the fixture block on each side of the wall 46 are provided with openings 66, 67. As will be explained below, the opening 66 receives a cylindrical socket member which serves as a fine aligning means in cooperation with an aligning pin on the press ram. The opening 67 similarly receives an aligning pin as will also be described below.

The load transmitting member 50 has a generally channel-shaped intermediate portion comprising a web 68 and depending legs 70, 72. These legs extend through narrow slots 74 (FIG. 4) in the block and the ends of the legs extend to the lower surface of the block which is centrally recessed as shown at 73. These legs are supported on a portion of the press during insertion of the wires so that the forces imposed during insertion of the wires into the terminals are transmited through the housing, through the load transmitting member, and to the press platen. The plastic fixture block itself is thus not stressed during the insertion operation.

Figure 9:
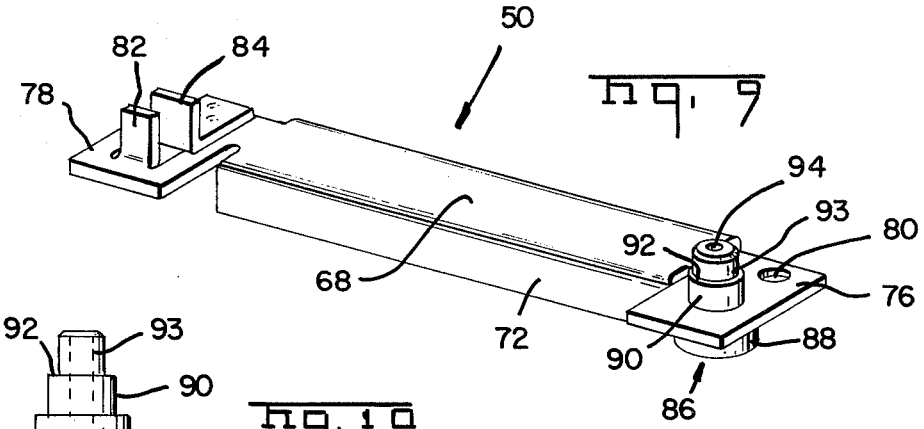
FIG. 9 is a perspective view of a force transmitting member which forms part of the fixture means.
Figure 10:
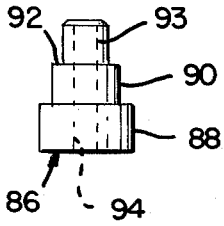
FIG. 10 is a view of a positioning sleeve which forms part of the fixture means.

As shown in FIG. 9, the ends of the load transmitting member 76, 78 are co-planar with the central web 68 and an opening 80 is provided in the end 76 for a fastener which secures this member to the fixture block. A circular opening is provided in the end 76 for the reception of an intermediate cylindrical portion 90 of the aligning member 86. This aligning member has an enlarged lower cylindrical portion 88 which fits in the opening 66, the intermediate portion 90 and a reduced diameter portion 93, a shoulder 92 being defined between the two cylindrical portions 90, 93. Aligning member 86 is provided with an axial bore 94 which receives an aligning pin on the press ram.

The enlarged end 78 has an ear 82 struck therefrom and an L-shaped bracket is welded to the end portion 78 in spaced relationship to the ear 82. The ear 82 and the ear 84 of the bracket define a guide means for the square aligning pin on the press ram.

Figure 3:
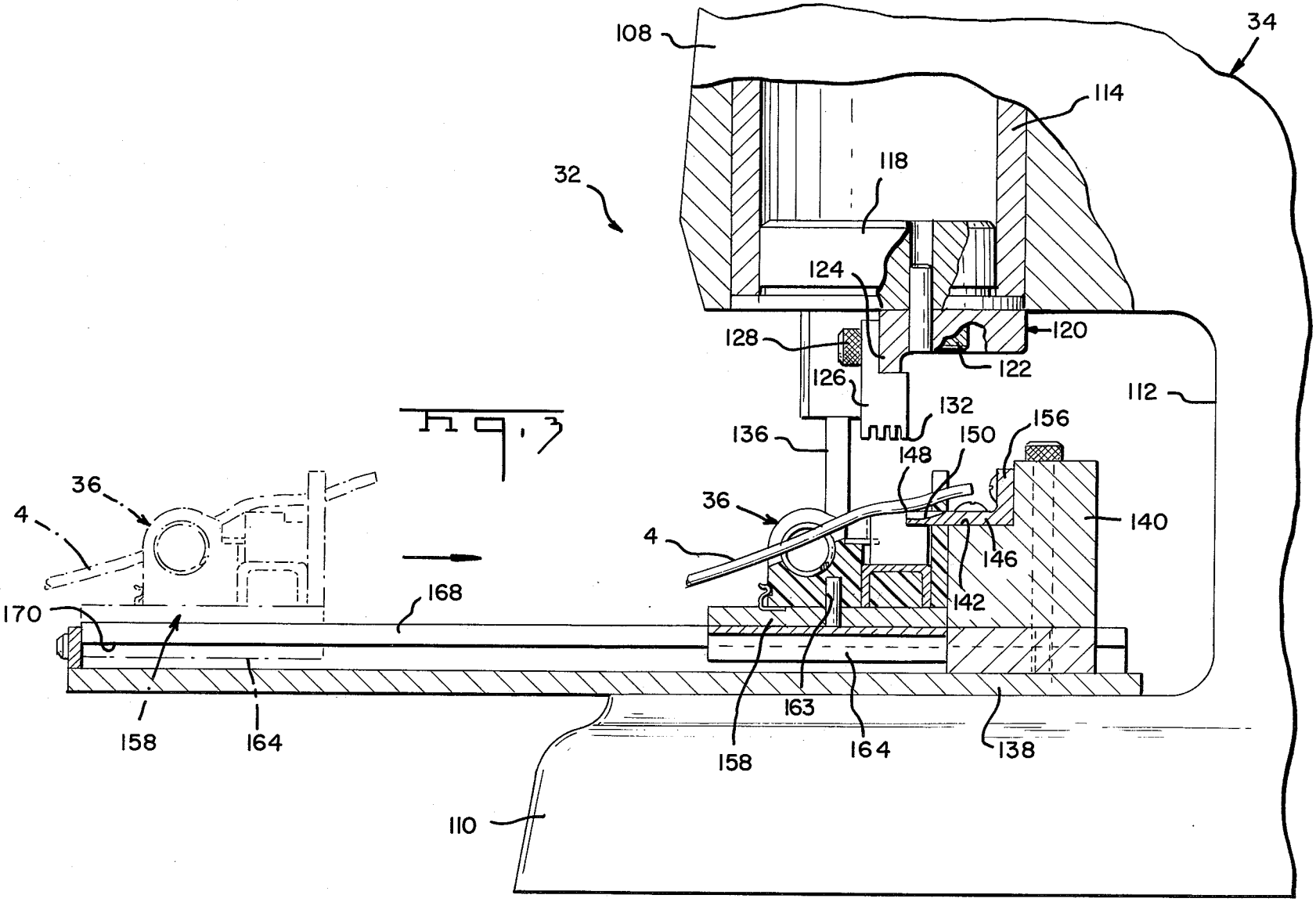
FIG. 3 is a cross-sectional view of the apparatus for FIG. 1 showing the positions of the parts immediately prior to a wire trimming and inserting process.

In accordance with the embodiment of FIGS. 1 and 3, the connector housing 9 is precisely positioned on the fixture by means of an aligning bar 96 which comprises a flat bar having a central section 97 from one side edge of which spaced apart teeth 98 extend. These teeth are dimensioned to be received in the recesses 29 in the housing so that when the housing is assembled to the bar as shown in FIG. 6, it will be precisely located thereon.

Aligning bar 96 has enlarged ends 99, 100, end 99 having a circular opening 102 therein which is dimensioned to receive the reduced diameter end 33 of the aligning member 86 so that the bar will rest on the shoulder 92. The intermediate portion 97 of the aligning bar is supported on a ledge 65 on the inner side of the wall 46 of the fixture block and the end 100 of the aligning bar has an opening 104 through which the ears 82, 84 extend when the aligning bar is positioned on the block as shown in FIG. 7.

The press 34 comprises a press frame having upper and lower arms 108, 110 and a vertically extending neck portion 112. A cylindrical ram 114 is slidable mounted in the upper arm 108 and is reciprocated into a suitable mechanism by a handle 116. A cylindrical tool holder 118 is secured in the lower end of the hollow cylindrical ram 114 and a general L-shaped tool mounting block 120 is secured to the downwardly facing surface of these tool holders by suitable fasteners 122. The mounting block 120 has a depending flange or arm 124 on which an inserter 126 is secured by fasteners 128. The inserter 126 comprises an elongated bar-like member having a plurality of spaced apart sets of insertion punches 132 extending from its lower surface. These punches are dimensioned to engage the wires at several points and push them into the wire receiving portions of the terminals in the connector. One edge 132 of the inserter 126 serves as a movable shearing edge in cooperation with a fixed shearing member 146 to shear the wires immediately prior to insertion.

Aligning pins 134, 136 extend downwardly from the ends of the tool holder block, the pin 134 having a circular cross section and being adapted to enter the bore 94 of the previously described aligning sleeve 86. The pin 136 has generally square cross sections and during downward movement of the ram, this pin moves between the ears 82, 84, through the opening in the load transmitting member 50, and into the opening 67 in the fixture block.

A base plate 138 is mounted on the upper surface of the press frame arm 110 and extends forwardly from the arm as shown in FIG. 3. A mounting block 140 is fixed to the inner end of this base plate and has a recess 142 adjacent to its lefthand or outwardly facing side (as viewed in FIG. 3) in which the fixed shear 146 is mounted. This fixed shear comprises an elongated shear bar having ears 156 on its ends by means of which it is secured to the mounting block 140. This shearing member is dimensioned to fit through the elongated slot 56 in the fixture body and the outer edge is provided with a plurality of spaced apart recesses 150 on its upper surface, the distance between adjacent recesses being the same as the spacing between the terminals in the connector. The edges defined by the recesses serve as shearing edges in cooperation with the previously identified shearing edge 132 of the inserter 126.

The fixture assembly is mounted on a slide member 158 which can be moved between inner and outer positions as shown in FIG. 3. This slide comprises a flat plate 160 in which there are two upstanding locating pins 162 which are adapted to be received in the openings 163 on the underside of the fixture body. A guide member 164 is secured against the underside of the plate 160 and the outer ends of this guide member are offset downwardly or away from the plate and are received within undercut portions 170 on the opposed sides of guide gibs 168. The guide gibs are secured to the upper surface of the base plate 138 as shown.

In use, the connector housing 9 is first assembled to the positioning bar 96 by forcing the teeth 82 on the positioning bar into the recesses 29 in the connector housing. By virtue of the dimensional precision of the teeth and the recesses, the housing will be precisely located on the positioning bar. The positioning bar 96 and housing are then assembled to the fixture body by positioning the housing between the sidewalls 46, 54 with the upper end 93 of aligning member 86 extending through the circular opening in the positioning bar. The elongated opening 104 in the positioning bar 96 will then be in alignment with the ears 82, 84 and the elongated opening 67 in the fixture body 38. The wires are then positioned in the fixture, each wire being placed in an aligned pair of the recesses 52, 58 and each wire will be then in alignment with a terminal in the connector housing.

The operations described thus far can be carried out at any convenient location, for example, on a work bench and after the wires have been positioned in the fixture, the wires and fixture are placed on the slide member with the pins 162 extending into the recesses 70. The slide member is then moved to its inner position as shown in FIG. 3 so that the fixture is against the block 140 and the fixed shear 146 will extend through the elongated slot 52. At this time, the wires and the connector housing will be in approximate or coarse alignment with the insertion punches by virtue of the fact that the fixture body is located on the pins 162.

The operator then rotates the handle forwardly to cause the ram 114 to move downwardly. During initial downward movement of the ram, and before the wires are engaged by the insertion punches, the aligning pins 134, 136 move into the fixture and bring about any slight movement thereof which is required to precisely align the insertion punches with the wires and the terminals. Upon further downward movement of the ram, the wires are cut by the cooperative shearing action of the edges 132, 154 (FIG. 8) and the trimmed ends of the wires are then inserted into the wire receiving portions of the terminals. The ram is then raised, the slide is moved outwardly from the press, and the connector with the wires connected to the terminals therein can be removed from the fixture.

As noted above, a coarse and fine aligning means are provided for bringing the fixture, and the connector mounted thereon, into precise alignment with the insertion punches on the inserter. Coarse alignment is achieved principally by the aligning pins 162 and the complementary openings 163 in the fixture block. When the slide member is moved to the solid line position of FIG. 3 and the ram is moved downwardly, the aligning pins 134, 136 will enter the complementary aligning sockets on the fixture, and as these pins move into the complementary sockets (the bore 94 in the aligning member 86 and the space between the ears 82, 84), the fixture will be brought into precise alignment so that the wires will be engaged by the inserter and moved into the wire receiving portions of the terminals. The arrangement shown of having a cylindrical aligning pin 134 and a cylindrical socket 94 in combination with a square cross-section aligning pin 136 and the ears 82, 84 is advantageous in that it obviates the requirement of precise parallelism of the two aligning pins and their complementary sockets. The circular openings in the enlarged end 76 of the force transmitting member 50 in combination with the cylindrical portion 90 of the aligning member 86 permits limited pivotal movement of the force transmitting member and, therefore, the fixture block. This limited pivotal movement in turn is brought about (when it is required to precisely align the parts) when the aligning pin 136 moves between the ears 82, 84.

A salient advantage of the invention is that the press 34 has all of the dimensionally critical machined metal parts therein such as, the inserter 126 and the fixed shear 146 while the fixture assembly 36 comprises a relatively inexpensive plastic block, the load transmitting member 50, and the positioning bar 96 which may be manufactured as a metal stamping. This means that a single insertion press 34 can be used with a relatively large number of inexpensive fixture assemblies 36 in a manufacturing operation to produce wired connectors at a high production rate but without an extremely high investment in tooling. For example, in a given manufacturing operation, several technicians may be employed in the operation of positioning wires in fixture assemblies and the fixture assemblies can then be given to the operator of a single press 34 who would carry out the wire trimming and insertion operations shown in the drawing on all of the fixture assemblies. This advantage is achieved by virtue of the fact that the precise alignment of the fixture assembly with the inserter of the press is achieved by the cooperative aligning means, the aligning pins and aligning openings in the fixture assembly, on the press and on the fixture assembly. It is important that the shearing member 146 is provided on the insertion press rather than on the fixture assembly since this member must be precisely dimensioned and must be of hardened tool steel. It is therefore, highly advantageous that only a single fixed shearing member is required for a plurality of fixture assemblies.

A further advantage of the invention is that connectors of different sizes, that is having different numbers of terminals therein, can be used on the apparatus described above without modification or adjustment of any kind. The positioning bar 96 has a plurality of teeth 98, each of which enters a recess 29 in the housing 9 as described above. The largest connector which can be accommodated with the apparatus shown would have a number of terminal positions equal to the number of teeth 98 in the positioning bar but a connector having a lesser number of positions could also be used in the apparatus. This smaller connector would merely be assembled to the positioning bar midway between the enlarged ends 99, 100 and wires would be located in the fixture such that they would be inserted into the terminals in this smaller connector.

Figure 11:
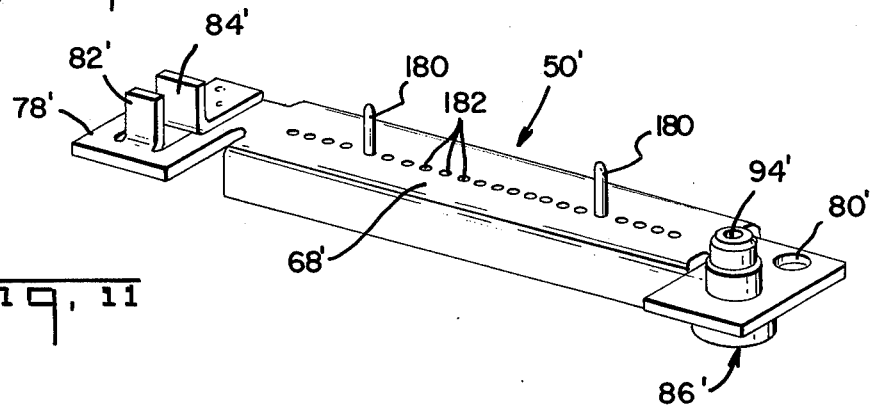
FIG. 11 is a perspective view of an alternative form of force transmitting member.

FIG. 11 shows an alternate arrangement for locating the connector housing in the fixture assembly. In accordance with this embodiment, the load transmitting member 50' is provided with a plurality of spaced-apart openings 182 in its web portion 68' and pins 180 are located in the appropriate openings for the connector to which wires are being attached. In accordance with this embodiment then, the positioning bar 96 is not required and the connector is positioned between the pins 180 on the load transmitting member which is assembled to the fixture block. As shown at 184, a recess is provided in the block for the lower ends of the pins 180.

Figure 12:
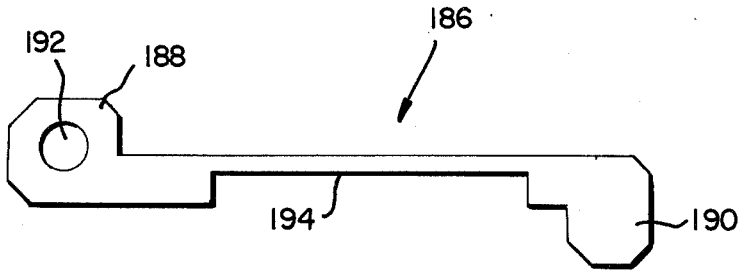
FIG. 12 is a plan view of an alternative type of positioning bar.

FIG. 12 shows a further embodiment comprising a positioning bar 186 having a notch 194 on one side edge thereof which receives the connector 9 therebetween. Ears 190, 188 extend laterally from the ends of the bar and the ear 188 has a circular opening which is dimensioned to rest upon the shoulder 92 of the aligning member 86. The ear 190 is supported on the upper surface of the web portion 68 of the load transmitting member 50 shown in FIG. 9. It will be noted that the ear 190 has an offset free end so that it will rest upon the surface of the web 68 while the intermediate portion of this positioning bar will be supported on the ledge 65.

Figure 13:
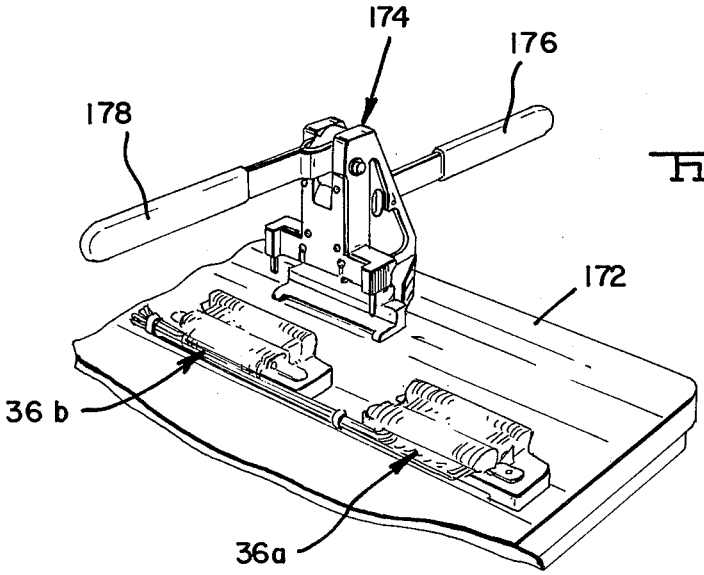
FIG. 13 is a fragmentary perspective view of a harness making apparatus which includes a wire trimming and inserting apparatus in accordance with the invention.

As shown in FIG. 13, the principles of the invention can be used advantageously in the manufacture of electrical harnesses by mounting a plurality of fixture assemblies 30*a,* 36*b,* on a panel member 172. The fixture assemblies would be mounted on the panel member at locations corresponding to the required locations of connectors in the harness being manufactured and after placement of connectors in the fixture assemblies, wires would be laced between and among the fixture assemblies in accordance with the routing of the conductors in the harness being manufactured. The tool 174 would then be used at each fixture assembly to trim the wires and insert them into the connector and the finished harness would then be removed from the panel 172. The tool 174 is of the general type disclosed and claimed in U.S. Pat. No. 3,845,535 except that the tool 174 has a fixed shearing member mounted thereon and has aligning pins as described above to align the inserter in the tool with the fixture at the time of wire insertion at each fixture assembly. Tool 174 has a rigid handle 176 by means of which it is carried and held on the surface 172 when it is being used and has an actuator handle 178 as described in the above-identified U.S. Pat. No. 3,845,535. This harness manufacturing method as shown in FIG. 13, is in accordance with the principles of the harness manufacturing method described in U.S. Pat. No. 3,859,724.

What is claimed is:

1. Apparatus for inserting wires into the wire-receiving portions of electrical contact terminals, said terminals being contained in an insulating housing with said wire-receiving portions arranged in side-by-side relationship in a row and with said wire-receiving portions facing in a common direction, said apparatus comprising:

a wire trimming and inserting apparatus and a fixture means, said fixture means comprising a fixture block having housing supporting surface for supporting said housing in a predetermined position, wire locating means for locating wires in side-by-side relationship in spaced relationship to said housing supporting surface with said wires in alignment with said terminals in a housing disposed on said housing supporting surface, said trimming and inserting apparatus comprising frame means, a ram in said frame means, said ram being reciprocable along a predetermined path, said ram having a movable wire shearing member and wire inserting means thereon, a fixed shearing member on said frame means on one side of said path for cooperation with said movable shearing member, said trimming and inserting apparatus having fixture locating means for locating said fixture block thereon at one end of said path with said fixed shearing member extending beside said row of wire-receiving portions of terminals in a housing on said housing supporting surface and with said wire-receiving portions in alignment with said wire inserting means whereby, upon placing a housing on said housing supporting surface, locating wires in said wire locating means placing said fixture block on said fixture locating means, and upon movement of said ram towards said fixture locating means said wires are trimmed and inserted into said wire-receiving portions of said terminals.

2. Apparatus as set forth in claim 1, said fixture block having a pair of spaced-apart walls extending therefrom, said housing supporting surface being between said walls, said wire locating means comprising wire-receiving notches in said walls.

3. Apparatus as set forth in claim 2, one of said walls having a slot extending therethrough, said fixed shearing member extending through said slot.

4. Apparatus as set forth in claim 2, said fixture block being of a plastic material, metallic load transmitting means on said block for transmitting loads imposed on said housing during insertion of said wires into said wire receiving portions of said terminals, said load transmitting means comprising a metallic plate on said housing supporting surface, said plate having leg portions extending through said block to said fixture locating means whereby forces imposed on said housing during insertion of said wires are transmitted through said leg portions to said fixture locating means.

5. Apparatus as set forth in claim 4, said metallic plate having selective locating means for selectively locating said connector thereon.

6. Apparatus as set forth in claim 5, said selective locating means comprising a plurality of pin-receiving holes in said metallic plate, and pins selectively located in two of said holes whereby said housing is located between said two pins.

7. Apparatus as set forth in claim 2 including positioning bar means for precisely positioning said housing on said housing supporting surface, said positioning bar means comprising a bar having locating means thereon for locating said housing on said positioning bar, and positioning bar locating means for precisely locating said positioning bar on said fixture block.

8. Apparatus as set forth in claim 1, said fixture block having a pair of spaced-apart walls extending therefrom, said housing supporting surface being between said walls, said wire locating means comprising wire-receiving notches in at least one of said walls, said notches having spring means therein for retaining said wires in said notches.

9. Apparatus as set forth in claim 8, said one wall having an opening extending therethrough transversely of, and intersecting, said notches, said spring means comprising a coil spring in said opening.

10. Apparatus as set forth in claim 1, said fixture locating means comprising coarse locating means for locating said fixture on said apparatus so that the wire-receiving portions of terminals in a housing on said housing supporting surface are in approximate alignment with said wire-inserting means, and fine locating means for precisely aligning said wire-receiving portions with said inserting means, said fine aligning means comprising interfitting means on said ram and said fixture block.

11. Apparatus for inserting wires into the wire-receiving portions of electrical contact terminals, said terminals being contained in an insulating housing with said wire-receiving portions arranged in side-by-side relationship in a row and with said wire-receiving portions facing in a common direction said apparatus comprising:

a press comprising a press frame, a ram in said frame, a press platen means, said ram being movable towards and away from said platen means, a wire inserter on said ram, said inserter being effective to move wires laterally of their axes and into said wire-receiving portions of terminals in a connector disposed on said platen means, shearing means for trimming said wires during movement thereof into said terminals, said shearing means comprising a movable shear bar on said ram and a fixed shear bar, said fixed shear bar being secured to said platen means, fixture means comprising wire locating means and housing positioning means, said wire locating means having means for locating said wires in side-by-side spaced-apart relationship with the distance between said wires being the same as the spacing between said wire-receiving portions of said terminals, said housing positioning means being effective precisely to locate said housing on said fixture means so that said wire-receiving portions of terminals in said housing are in alignment with wires on said wire locating means, and aligning means for aligning said fixture means with said wire inserter, said aligning means comprising cooperable interfitting means on said ram and on said fixture means, said aligning means extending in the direction of movement of said ram means towards said press platen and being effective to align said inserter during movement of said ram towards said press platen with wires in said wire locating means and with wire receiving portions of said terminals in a housing disposed in said housing positioning means whereby, upon positioning a housing on said fixture means and locating wires in said wire locating means, and upon positioning said fixture means on said platen means and thereafter causing said ram to move towards said platen means, said wires are trimmed and inserted into said wire-receiving portions of said terminals.

12. A fixture which is intended for use with a wire trimming and inserting apparatus of the type having fixture supporting surface portions, a wire inserter, a fixed shearing member, and a movable shearing member, said fixed shearing member being disposed proximate to said fixture supporting surface portions, said wire inserter and said movable shearing member being movable toward and away from said fixture supporting surface portions, said apparatus being effective to trim the ends of wires and insert the trimmed wire ends into the wire-receiving portions of electrical contact terminals which are contained in a housing with said wire-receiving portions arranged in side-by-side relationship in a row, said fixture comprising:

a fixture block having a housing supporting surface, housing positioning means for locating said housing in a predetermined position on said housing supporting surface, wire locating means for locating wires in side-by-side spaced-apart relationship with the distance between said wires being the same as the spacing between said wire-receiving portions of said terminals and with said wires in alignment with, and spaced from, said terminals in a housing disposed on said housing supporting surface, said fixture block providing clearance for said fixed shearing member when said fixture is on said fixture supporting surface portions so that said fixed shearing member extends beside said row of wire-receiving portion of terminals in a housing disposed on said housing supporting surface whereby, upon positioning said housing on said housing supporting surface, locating wires in said wire locating means, positioning said fixture on said fixture supporting surface portions, and thereafter causing said wire inserter and said movable shearing member to move towards said fixture supporting surface portions, said wires are trimmed by said fixed and movable shearing members and said wires are inserted into said wire-receiving portions of said terminals in said housing.

13. A fixture as set forth in claim 12, said fixture block having a pair of spaced apart walls extending therefrom, said housing supporting surface being between said walls, said wire locating means being in at least one of said walls.

14. A fixture as set forth in claim 12, said fixture block being of a plastic material, metallic load transmitting means on said block for transmitting loads imposed on said housing during insertion of said wires into said wire receiving portions of said terminals, said load transmitting means comprising a metallic plate on said housing supporting surface, said plate having leg portions extending through said block to said fixture supporting surface portions whereby forces imposed on said housing during insertion of said wires are transmitted by said leg portions to said fixture supporting surface portions.

15. A fixture as set forth in claim 14, said housing positioning means comprising spaced apart stop means extending from said metallic plate whereby said housing is positioned between said stop means.

16. A fixture as set forth in claim 13, one of said walls having a slot extending thereacross, said slot being dimensioned to receive said fixed shearing member and constituting said clearance for said fixed shearing member.

17. A fixture as set forth in claim 12, said fixture having aligning means thereon precisely to align said fixture with said wire inserter and said movable shearing member, said aligning means comprising portions of said fixture which interfit with complementary aligning means which are movable with said inserter during movement of said inserter towards said fixture supporting surface portions.

18. A fixture as set forth in claim 17, said aligning means comprising socket means in said fixture, said complementary aligning means comprising aligning pins.

19. A fixture as set forth in claim 12, said housing positioning means comprising a positioning bar, said positioning bar having locating means thereon for locating said housing on said positioning bar, and positioning bar locating means for precisely locating said positioning bar on said fixture block.

20. A fixture as set forth in claim 13, said at least one wall having spaced apart notches therein, said notches constituting said wire locating means, and spring means in said nothces for retaining said wires in said notches.

21. A fixture as set forth in claim 20, said at least one wall having an opening extending transversely therethrough and intersecting said notches, said spring means comprising a coil spring in said opening.

* * * * *